US012460898B2

(12) United States Patent
Chen

(10) Patent No.: US 12,460,898 B2
(45) Date of Patent: Nov. 4, 2025

(54) WATER SPRAY STRUCTURE OF A CONTINUOUS SHOOTING TOY WATER GUN

(71) Applicant: Bo Chen, Shantou (CN)

(72) Inventor: Bo Chen, Shantou (CN)

(73) Assignee: Shantou P&C Toys Company Limited, Shantou (CN)

( * ) Notice: Subject to any disclaimer, the term of this patent is extended or adjusted under 35 U.S.C. 154(b) by 188 days.

(21) Appl. No.: 18/533,138

(22) Filed: Dec. 7, 2023

(65) Prior Publication Data

US 2025/0012540 A1 Jan. 9, 2025

(30) Foreign Application Priority Data

Jul. 5, 2023 (CN) ..... 202321752463.4

(51) Int. Cl.
*F41B 9/00* (2006.01)

(52) U.S. Cl.
CPC ..... *F41B 9/00* (2013.01)

(58) Field of Classification Search
CPC ..... F41B 9/00
See application file for complete search history.

(56) References Cited

U.S. PATENT DOCUMENTS 4,706,848 A * 11/1987 D'Andrade ..... F41B 9/0037 222/340
4,743,030 A * 5/1988 Auer ..... F41J 5/24 434/327
4,768,681 A * 9/1988 Dean ..... F41B 9/0078 2/160
5,284,274 A * 2/1994 Lee ..... F41B 9/0031 222/386
5,322,191 A * 6/1994 Johnson ..... F41B 9/0018 222/401
5,323,755 A * 6/1994 Hsieh ..... F41B 11/54 124/66
5,381,928 A * 1/1995 Lee ..... F41B 9/0065 222/386
5,829,635 A * 11/1998 Brovelli ..... F41B 9/0037 222/189.1

(Continued)

FOREIGN PATENT DOCUMENTS

CN 113686199 A * 11/2021 ..... F41B 9/0037
GB 2132494 A * 7/1984 ..... F41B 9/0065

*Primary Examiner* — Donnell A Long
(74) *Attorney, Agent, or Firm* — Minder Law Group; Willy H. Wong

(57) ABSTRACT

The water spray structure of a continuous shooting toy water gun of the present invention comprises: a housing; a water spray chamber, provided at a front end of the housing; a rear end of the water spray chamber, the rear end of the water spray chamber fixedly connected to the front end of the housing to form an integral unit; a nozzle provided at a front end of the water spray chamber; a water inlet provided at a bottom surface of the water spray chamber, the bottom surface of the water spray chamber being connected to the water storage chamber by the water inlet; a piston positioned inside the water spray chamber; an electric motor installed at a rear end of the housing; a swinging mechanism; and a driving mechanism connected to a motor shaft of the electric motor and thereby drives the piston through the swinging mechanism.

6 Claims, 2 Drawing Sheets

(56) References Cited

U.S. PATENT DOCUMENTS 5,876,995 A * 3/1999 Bryan ..... C12N 9/0071
435/189
6,247,995 B1 * 6/2001 Bryan ..... B05B 7/2472
435/189

* cited by examiner

WATER SPRAY STRUCTURE OF A CONTINUOUS SHOOTING TOY WATER GUN

RELATED APPLICATIONS

This application claims priority to Chinese Patent Application Number 202321752463.4, filed Jul. 5, 2023.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

TECHNICAL FIELD

The present invention relates to a water spray structure and pertains to the technical field of toy products.

BACKGROUND

A toy water gun is a type of toy gun that can be filled with water and shoots out water streams. In comparison to toy guns that shoot solid projectiles, water guns are safer as they utilize water as ammunition. Most toy water guns currently available are designed to utilize tap water pressure and external force to increase the water pressure inside a rubber tube within the toy gun. This design allows the water pressure to surpass that of tap water, resulting in a longer shooting range and creating a more exhilarating and enjoyable experience for users. Moreover, water guns contribute to cognitive development of children, particularly during group games where they foster teamwork and enhance emotional intelligence among children and their companions. It is no surprise that water guns have become highly coveted toys for children, with many longing to possess a large water gun. However, traditional toy water guns have drawbacks such as requiring users to manually squeeze a water storage chamber inside the gun with their fingers, resulting in a slow shooting rate and potential discomfort and soreness in the fingers after prolonged use due to the release of only one water stream with each squeeze.

SUMMARY

An objective of one embodiment of the present invention is to provide a water spray structure of a continuous shooting toy water gun, which addresses the problem in the prior art that traditional toy water guns require users to manually squeeze a water storage chamber inside the gun with their fingers, resulting in a slow shooting rate and potential discomfort and soreness in the fingers after prolonged use due to the release of only one water stream with each squeeze.

The objective of the present invention can be achieved by the following technical solution. In an embodiment of the present invention, a water spray structure of a continuous shooting toy water gun with a water storage chamber, comprises:

- a housing;
- a water spray chamber, provided at a front end of the housing;

- a rear end of the water spray chamber, the rear end of the water spray chamber being fixedly connected to the front end of the housing to form an integral unit;
- a nozzle provided at a front end of the water spray chamber;
- a water inlet provided at a bottom surface of the water spray chamber, the bottom surface of the water spray chamber being connected to the water storage chamber by the water inlet;
- a piston positioned inside the water spray chamber;
- an electric motor installed at a rear end of the housing;
- a swinging mechanism; and
- a driving mechanism connected to a motor shaft of the electric motor and thereby drives the piston through the swinging mechanism.

Further, the driving mechanism comprises a motor gear, a driving gear assembly, and a transition gear assembly; the motor gear is coaxially and fixedly sleeved and mounted on the motor shaft of the electric motor, the transition gear assembly and the driving gear assembly are sequentially arranged inside the housing from front to rear, the motor gear is connected to the driving gear assembly, the driving gear assembly is connected to the transition gear assembly, and the transition gear assembly is meshed with the swinging mechanism.

Further, the driving gear assembly comprises a first gear and a second gear which are coaxially and fixedly connected, the first gear being engaged with the motor gear, and the second gear being meshed with the transition gear assembly.

Further, wherein the transition gear assembly comprises a third gear and a fourth gear which are coaxially and fixedly connected, the third gear being engaged with the second gear, and the fourth gear being meshed with the swinging mechanism.

Further, the swinging mechanism comprises a swing rod and a swing rod driving gear, the swing rod driving gear being pivotally connected to an inner shaft of the housing and engaged with the fourth gear, and the swing rod being pivotally connected at a rear end to an edge of the swing rod driving gear and pivotally connected at a front end to the piston.

Compared to the prior art, the present invention has the following advantages: 1. By utilizing an electric motor to drive the piston in a reciprocating motion within the water spray chamber, the present invention enables continuous shooting of water streams from the water gun. As a result, users only need to press down a trigger of the water gun to shoot water streams continuously, eliminating the potential discomfort and soreness in the fingers that may occur with prolonged use of traditional toy water guns.

2. The present invention achieves reciprocating motion of the piston through a combined driving method that combines continuous gear driving and swing rod driving. This not only ensures high transmission reliability but also provides a simple structure, making it convenient for replacement and maintenance purposes.

DETAILED DESCRIPTION

Figure 1:
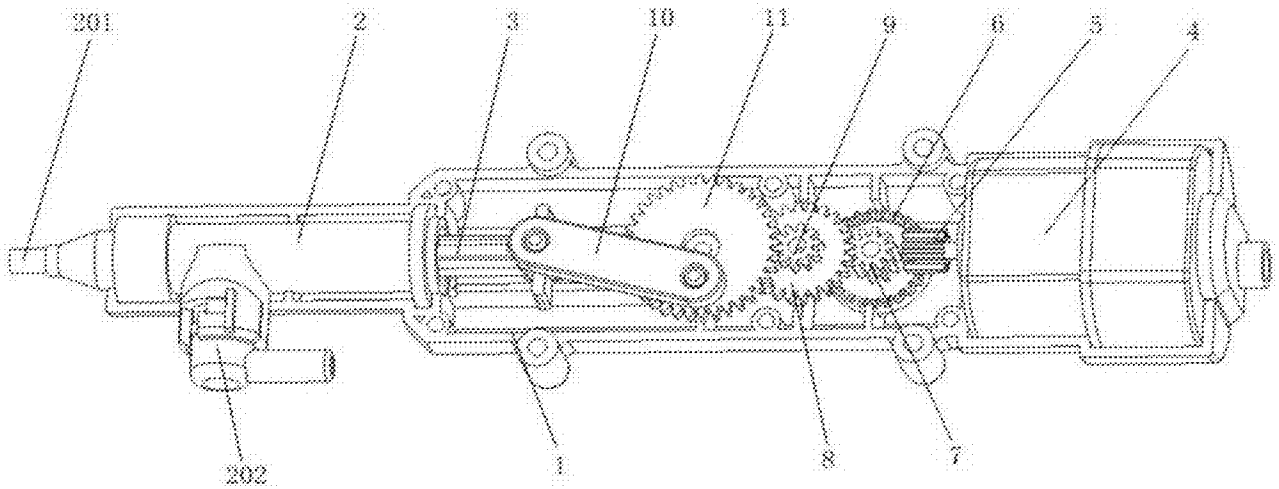
FIG. 1 is a schematic diagram of an embodiment of a water spray structure of the present invention.
Figure 2:
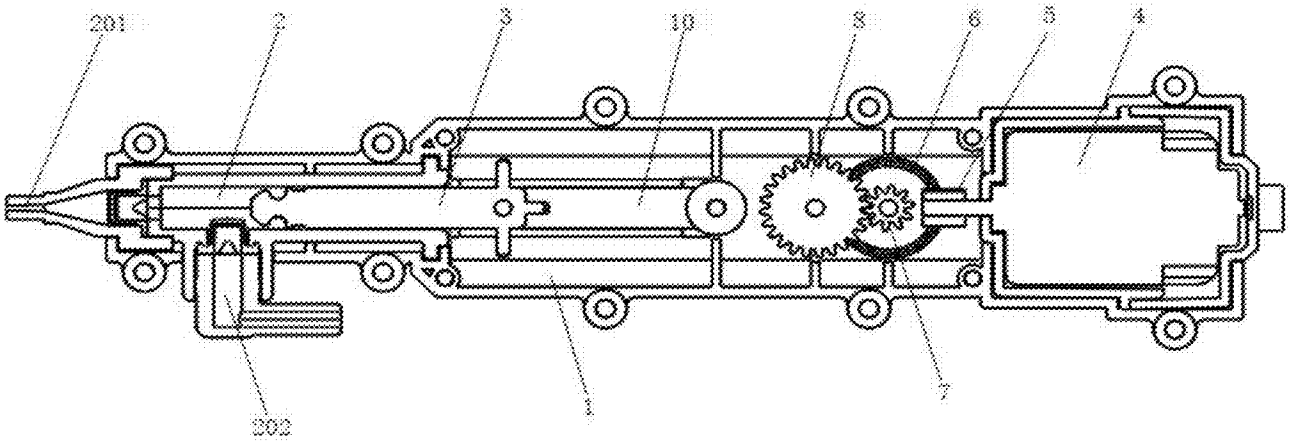
FIG. 2 is a front cross-sectional view thereof.

Embodiment I: As illustrated in conjunction with FIGS. 1 and 2, in this embodiment of the present invention, a water spray structure of a continuous shooting toy water gun with a water storage chamber, comprises:

a housing 1;

a water spray chamber 2, provided at a front end of the housing 1;

a rear end of the water spray chamber 2, the rear end of the water spray chamber 2 being fixedly connected to the front end of the housing 1 to form an integral unit;

a nozzle 201 provided at a front end of the water spray chamber 2;

a water inlet 202 provided at a bottom surface of the water spray chamber 2, the bottom surface of the water spray chamber 2 being connected to the water storage chamber by the water inlet 202;

a piston 3 positioned inside the water spray chamber 2;

an electric motor 4 installed at a rear end of the housing 1;

a swinging mechanism; and a driving mechanism connected to a motor shaft of the electric motor 4 and thereby drives the piston 3 through the swinging mechanism.

Embodiment II: As illustrated in conjunction with FIGS. 1 and 2, in this embodiment of a water spray structure of a continuous shooting toy water gun of the present invention, the driving mechanism comprises a motor gear 5, a driving gear assembly, and a transition gear assembly; the motor gear 5 is coaxially and fixedly sleeved and mounted on the motor shaft of the electric motor 4, the transition gear assembly and the driving gear assembly are sequentially arranged inside the housing 1 from front to rear, the motor gear 5 is connected to the driving gear assembly, the driving gear assembly is connected to the transition gear assembly, and the transition gear assembly is meshed with the swinging mechanism.

In this embodiment, the motor gear 5 is made of plastic and is coaxially and fixedly connected to the motor shaft of the electric motor 4 by means of an interference fit.

The remaining components and connection relationships closely resemble those in Embodiment I.

Embodiment III: As illustrated in conjunction with FIGS. 1 and 2, in this embodiment of a water spray structure of a continuous shooting toy water gun of the present invention, the driving gear assembly comprises a first gear 6 and a second gear 7 which are coaxially and fixedly connected, the first gear 6 being engaged with the motor gear 5, and the second gear 7 being meshed with the transition gear assembly.

The first gear 6 and the second gear 7 are both made of plastic. This design extends their service life and effectively prevents rusting, ensuring their optimal performance in long-term operation in humid environments.

The remaining components and connection relationships closely resemble those in Embodiment II.

Embodiment IV: As illustrated in conjunction with FIGS. 1 and 2, in this embodiment of a water spray structure of a continuous shooting toy water gun of the present invention, the transition gear assembly comprises a third gear 8 and a fourth gear 9 which are coaxially and fixedly connected, the third gear 8 being engaged with the second gear 7, and the fourth gear 9 being meshed with the swinging mechanism.

The third gear 8 and the fourth gear 9 are both made of plastic. This design extends their service life and effectively prevents rusting, ensuring their optimal performance in long-term operation in humid environments.

The remaining components and connection relationships closely resemble those in Embodiment III.

Embodiment V: As illustrated in conjunction with FIGS. 1 and 2, in this embodiment of a water spray structure of a continuous shooting toy water gun of the present invention, the swinging mechanism comprises a swing rod 10 and a swing rod driving gear 11, the swing rod driving gear 11 being pivotally connected to an inner shaft of the housing 1 and engaged with the fourth gear 9, and the swing rod 10 being pivotally connected at a rear end to an edge of the swing rod driving gear 11 and pivotally connected at a front end to the piston 3.

The swing rod 10 and the swing rod driving gear 11 are both made of plastic. This design extends their service life and effectively prevents rusting, ensuring their optimal performance in long-term operation in humid environments.

The remaining components and connection relationships closely resemble those in Embodiment I or Embodiment IV.

Working Principle

The electric motor 4 drives the motor gear 5 to rotate, the motor gear 5 in turn rotates the first gear 6. The second gear 7, which rotates coaxially with the first gear 6, causes the third gear 8 to rotate. The fourth gear 9, rotating coaxially with the third gear 8, causes the swing rod driving gear 11 to rotate. The rotation of the swing rod driving gear 11 transfers force through the swing rod 10 to the piston 3, resulting in reciprocating motion of the piston 3 inside the water spray chamber 2. When the piston 3 moves backward in the water spray chamber 2, a negative pressure is created, drawing water from the water storage chamber of the water gun through the water inlet 202 into the water spray chamber 2. Conversely, when the piston 3 moves forward, a positive pressure is generated, expelling the water from the water spray chamber 2 through the nozzle 201. Through continuous reciprocating motion of the piston 3 within the water spray chamber 2, water is continuously drawn from the water storage chamber and shot out through the nozzle 201, realizing continuous shooting of water streams.

The above describe preferred embodiments of the present invention, but they do not impose any limitations. While these embodiments have been disclosed, they are not intended to restrict the present invention. A person skilled in the art can make changes or equivalent modifications based on the above disclosure without deviating from the technical scope of the present invention. Any modifications, equivalent substitutions, improvements, or similar changes made to the above embodiments that fall within the technical essence and principles of the present invention are within the scope of protection of the present invention's technical solution.

REFERENCED PARTS

1 Housing
2 Water spray chamber
3 Piston
4 Electric motor
5 Motor gear
6 First gear
7 Second gear
8 Third gear
9 Fourth gear
10 Swing rod
11 Swing rod driving gear
201 Nozzle
202 Water inlet

The invention claimed is:

1. A water spray structure of a continuous shooting toy water gun with a water storage chamber, comprising:

a housing;

a water spray chamber, provided at a front end of the housing;

a rear end of the water spray chamber, the rear end of the water spray chamber fixedly connected to the front end of the housing to form an integral unit;

a nozzle provided at a front end of the water spray chamber;

a water inlet provided at a bottom surface of the water spray chamber, the bottom surface of the water spray chamber connected to the water storage chamber by the water inlet;

a piston positioned inside the water spray chamber;

an electric motor installed at a rear end of the housing;

a swinging mechanism; and a driving mechanism connected to a motor shaft of the electric motor and thereby drives the piston through the swinging mechanism.

2. The water spray structure of a continuous shooting toy water gun with a water storage chamber as claimed in claim 1, wherein the driving mechanism comprises a motor gear, a driving gear assembly, and a transition gear assembly; and wherein the motor gear is coaxially and fixedly sleeved and mounted on the motor shaft of the electric motor, the transition gear assembly and the driving gear assembly are sequentially arranged inside the housing from front to rear, the motor gear is connected to the driving gear assembly, the driving gear assembly is connected to the transition gear assembly, and the transition gear assembly is meshed with the swinging mechanism.

3. The water spray structure of a continuous shooting toy water gun with a water storage chamber as claimed in claim 2, wherein the driving gear assembly comprises a first gear and a second gear which are coaxially and fixedly connected, the first gear engaged with the motor gear, and the second gear meshed with the transition gear assembly.

4. The water spray structure of a continuous shooting toy water gun with a water storage chamber as claimed in claim 3, wherein the transition gear assembly comprises a third gear and a fourth gear which are coaxially and fixedly connected, the third gear engaged with the second gear, and the fourth gear meshed with the swinging mechanism.

5. The water spray structure of a continuous shooting toy water gun with a water storage chamber as claimed in claim 4, wherein the swinging mechanism comprises a swing rod and a swing rod driving gear, the swing rod driving gear pivotally connected to an inner shaft of the housing and engaged with the fourth gear, and the swing rod pivotally connected at a rear end to an edge of the swing rod driving gear and pivotally connected at a front end to the piston.

6. The water spray structure of a continuous shooting toy water gun with a water storage chamber as claimed in claim 1, wherein the swinging mechanism comprises a swing rod and a swing rod driving gear, the swing rod driving gear pivotally connected to an inner shaft of the housing and engaged with the fourth gear, and the swing rod pivotally connected at a rear end to an edge of the swing rod driving gear and pivotally connected at a front end to the piston.

* * * * *